US006923485B1

(12) United States Patent
Bauswell

(10) Patent No.: US 6,923,485 B1
(45) Date of Patent: Aug. 2, 2005

(54) ERGONOMIC CONTAINER

(76) Inventor: Todd Bauswell, 4611 Briarwood, Royal Oak, MI (US) 48073

( * ) Notice: Subject to any disclaimer, the term of this patent is extended or adjusted under 35 U.S.C. 154(b) by 84 days.

(21) Appl. No.: 10/335,762

(22) Filed: Jan. 2, 2003

Related U.S. Application Data

(60) Provisional application No. 60/344,361, filed on Jan. 4, 2002, provisional application No. 60/361,723, filed on Mar. 6, 2002, and provisional application No. 60/389,540, filed on Jun. 19, 2002.

(51) Int. Cl.[7] ..... E04G 21/02

(52) U.S. Cl. ..... 294/3.5; 220/762; 224/222

(58) Field of Search ..... 294/3.5, 55, 172, 294/167, 144, 137; 224/222, 218, 219, 220; 220/762, 757; 16/425, 430

(56) References Cited

U.S. PATENT DOCUMENTS

| | | | | | |
|---|---|---|---|---|---|
| 2,099,433 | A | * | 11/1937 | Bloomfield | 108/11 |
| 2,958,566 | A | * | 11/1960 | Buck | 108/44 |
| 3,315,858 | A | * | 4/1967 | Horner | 294/143 |
| 3,476,431 | A | * | 11/1969 | Chazelle | 294/3.5 |
| 3,504,832 | A | * | 4/1970 | Corvetti | 294/144 |
| 5,025,919 | A | * | 6/1991 | Brinker et al. | 206/214 |
| 5,261,584 | A | | 11/1993 | Albert | |
| 5,358,161 | A | | 10/1994 | Perugini | |
| 5,634,568 | A | * | 6/1997 | Wawrzyniak | 220/510 |
| 5,971,101 | A | | 10/1999 | Taggart | |
| 6,006,936 | A | | 12/1999 | Przybylowicz | |
| 6,454,124 | B1 | | 9/2002 | Edwards et al. | |
| 6,622,885 | B1 | * | 9/2003 | Erman | 220/571 |
| 2002/0182318 | A1 | | 12/2002 | Kruskamp | |

* cited by examiner

*Primary Examiner*—Joseph C. Merek
(74) *Attorney, Agent, or Firm*—Luedeka, Neely & Graham, P.C.

(57) ABSTRACT

A container for containing an amount material or another container. The container includes a support for engaging an arm of a user. The container also includes a handle. The apparatus also can employ an adjustable handle, adjustable from a first position to a second position. The container is particularly suited for drywall administrators and builders.

15 Claims, 22 Drawing Sheets

ERGONOMIC CONTAINER

RELATED APPLICATIONS

This application claims the benefit of U.S. Provisional Application No. 60/344,361 filed on Jan. 4, 2002, entitled Ergonomic Material Container/Holder, 60/361,723 filed on Mar. 6, 2002, entitled Ergonomic Material Container/Holder With Adjustable Handle, and 60/389,540 filed on Jun. 19, 2002, entitled Ergonomic Pan Holder.

FIELD OF THE INVENTION

The present invention is generally directed to an apparatus for holding a material. More particularly, the invention is directed to an ergonomically designed container for lessening the effort required to hold and carry material thereby reducing the potential for injury and fatigue.

BACKGROUND OF THE INVENTION

Rectangular stainless steel or plastic mud pans of various sizes are used to hold joint compound during the drywall finishing process. Joint compound or mud pans are generally 10, 12, or 14 inches in length and 4½ inches wide at the top, and 3½ inches deep, having flat bottoms. These pans are used primarily during the drywall finishing process to hold joint compound while working.

There are many problems associated in working with these pans. For one, the pans are typically held for hours at a time during the work day which can be extremely uncomfortable to the holder. The pans are generally rectangular pans with no modifications for holding them other than holding the base of the container in the palm of a user's hand or by gripping one end of the pan while resting the remaining pan on the forearm. Accordingly, there is stress placed on the hand, wrist, and arm due to the unnatural position needed to hold and balance the pan. The resulting fatigue on the arm often causes cramping and could lead to the development of carpal tunnel syndrome by the user.

Therefore, an ergonomic container is needed.

SUMMARY OF THE INVENTION

The present invention operates to reduce fatigue, cramping and chance of injury on the arm while utilizing the disclosed apparatus. The apparatus enables one to work more efficiently and comfortably for longer periods of time by decreasing the stress placed on the arm during use. Accordingly, an ergonomically designed apparatus for use in the application of a material includes a container having a base including upper and lower base surfaces. Walls attach to the upper surface of the base, wherein the walls and base define a receiving space. The apparatus includes a handle for providing support to a user's hand attached to the lower base surface. The apparatus further includes a support having upper and lower surfaces, wherein a portion of the support's upper surface is attached to the lower surface of the base, the support being sized and dimensioned to rest upon a user's arm providing an ergonomic orientation of a user's arm in relation to the apparatus. The handle and support enable a user to orient the apparatus. In another aspect, the handle is adjustable, providing for individual comfort and balance. Accordingly, a user can maintain his hand, wrist and arm in a more straight and natural position while using the apparatus. For added convenience measurement levels may be indicated within the pan.

In another aspect, an apparatus is designed to contain a pan or other container having predetermined dimensions for containing a material.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
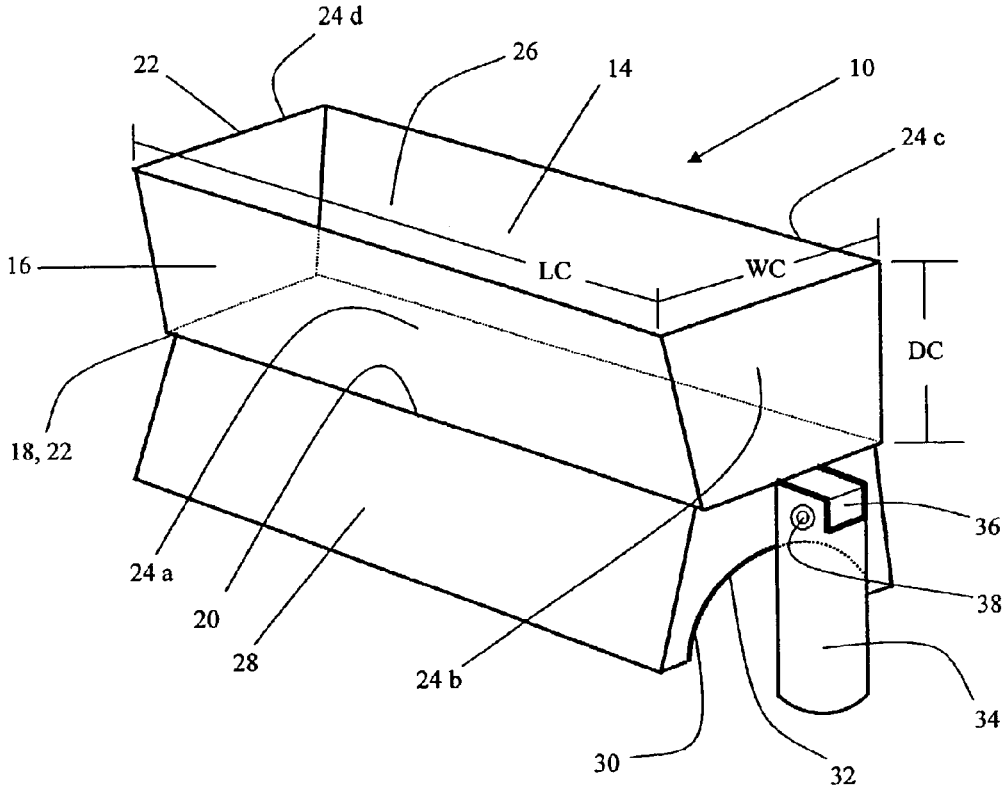
FIG. 1 is an isometric view of an ergonomic material holding apparatus according to an embodiment of the invention.

Referring now to FIGS. 1–5, FIG. 1 is an isometric view of an ergonomic material holding apparatus 10, according to an embodiment of the invention. A user 12 (FIG. 4) uses the ergonomic material holding apparatus 10 to contain a material 14, such as concrete, drywall material, and other material types typically applied manually during building and other similar projects. The apparatus 10 is particularly useful to individuals who work in the building industry wherein various types of materials must be supported for prolonged time periods by a user 12. The apparatus 10 is particularly useful for material mixing applications, such as drywall applications and the like.

As shown in FIGS. 1–5, the apparatus 10 includes a container 16 for containing a material 14 or for receiving and supporting another container, such as a mixing pan, etc. The container 16 includes a base 18 having upper and lower surfaces 20 and 22, respectively. Preferably the container 16 has a length LC of between about nine and about fifteen inches, a width WC of between about two and about five inches, and a depth DC of between about two and about four inches. The container 16 includes four walls 24*a*–24*d* which extend from the upper surface 20 of the base 18, defining a space 26 for receiving a material or another material pan which can hold the material. Each wall 24*a*–24*d* defines an angle with respect to the base 18, which corresponds to the wall angles of a standard mud pan. Preferably, the angles range from about ninety degrees to about one hundred and thirty degrees.

With continuing reference to FIGS. 1–5, the apparatus 10 includes a support 28 attached to the lower surface 22 of the base 18. As shown for this embodiment, the support 28 has a substantially concave shape enabling users having various arm sizes to use the apparatus 10. It will be apparent to those skilled in the art that other support shapes may be used and the invention is not intended to be limited to any specific embodiment or examples as disclosed herein. For example, the support 28 could have a substantially rectangular or segmented shape.

Preferably, a pad 30 is attached to the lower surface 32 of the support 28. The pad 30 may be fabricated from any pliable material, such as foam, rubber, and the like. The pad 30 can be glued to or releasably affixed to the support 28, such as by tape, Velcro, and other adhesive means. When a user 12 uses the apparatus 10, the pad 30 provides a pliable support between the lower support surface 32 and the user's arm, providing additional ergonomic properties to the apparatus 10. The pad 30 prevents the lower support surface 32 from uncomfortably impinging upon or irritating the user's arm. Preferably, the pad 30 has a thickness of between about ⅛ inch and about ¾ inches. The pad 32 can cover the entire lower surface 32 of the support 28 or a portion thereof.

Figure 2:
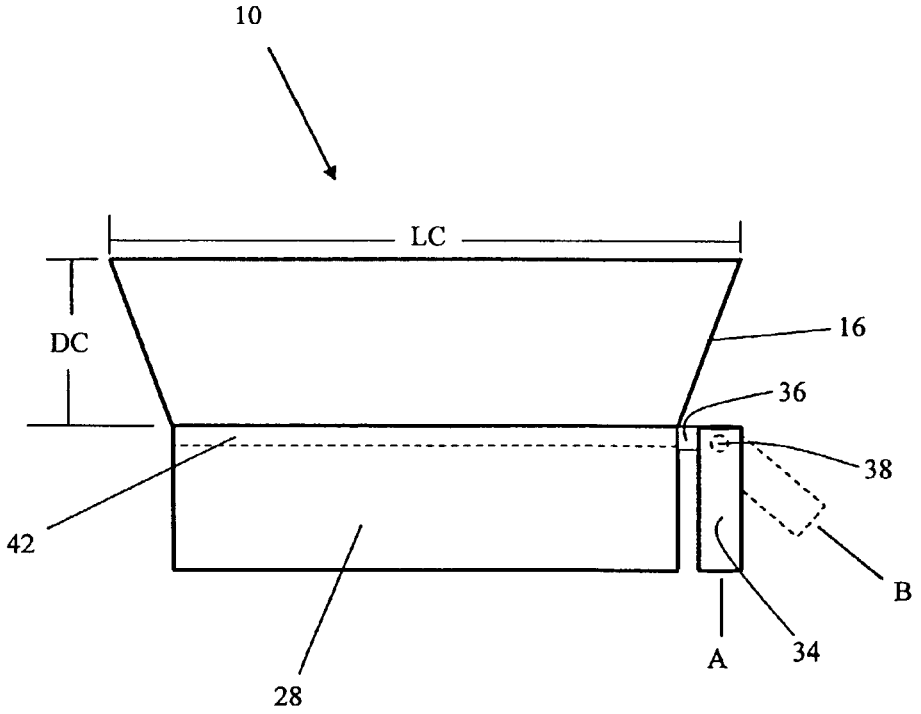
FIG. 2 is a side-view of the apparatus of FIG. 1 depicting an adjustable handle in various positions.
Figure 3:
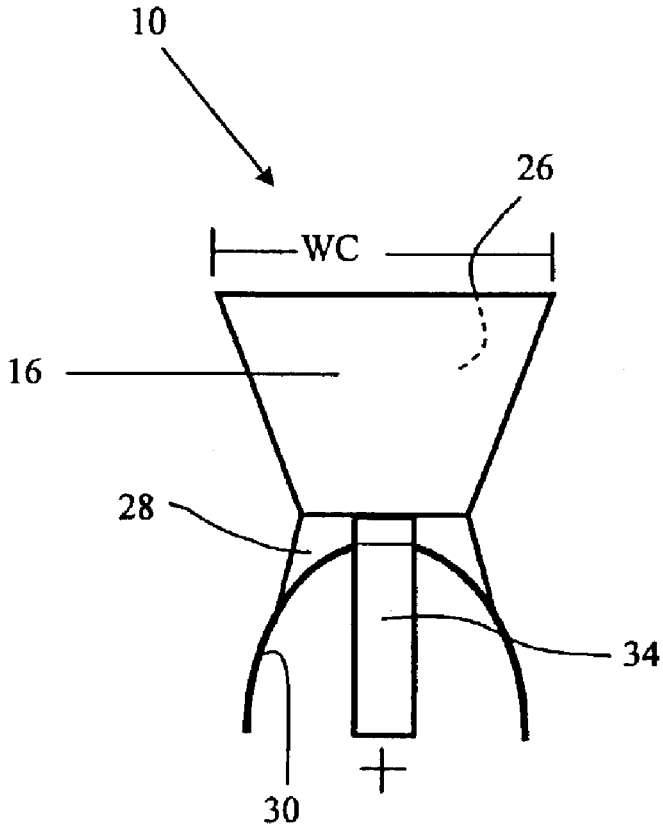
FIG. 3 is a front-view of the apparatus of FIG. 1.

According to this embodiment, the apparatus 10 further includes a handle 34. Most preferably, the handle 34 is operable to adjust through a plurality of positions relative to the support 28. The handle 34 adjusts through a plurality of positions depending upon the user's size and particular application when using the apparatus 10. The handle is shown in a first handle position A in FIG. 1. FIG. 2 depicts the apparatus 10 wherein the handle 34 is in a second handle position B as well as the first handle position A.

For this embodiment, the handle 34 attaches and rotates about a protrusion 36 extending from the front of the support 28 or the container 16. A pin 38 or other fastener fastens the handle 34 to the protrusion 36 via through-hole 40. Once the handle 34 is attached to the protrusion 36, the handle can rotate through a plurality of positions about the pin 38.

Figure 4:
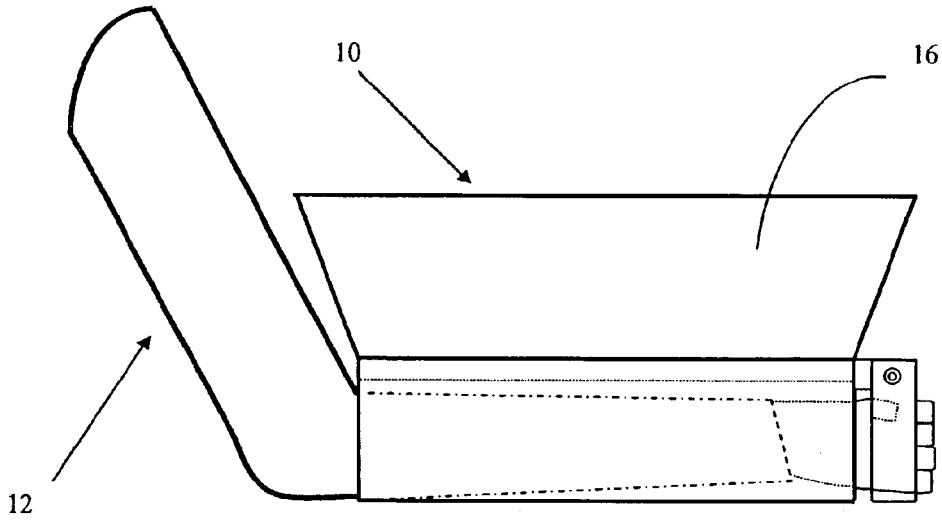
FIG. 4 is a side-view of a user holding the apparatus of FIG. 1.
Figure 5:
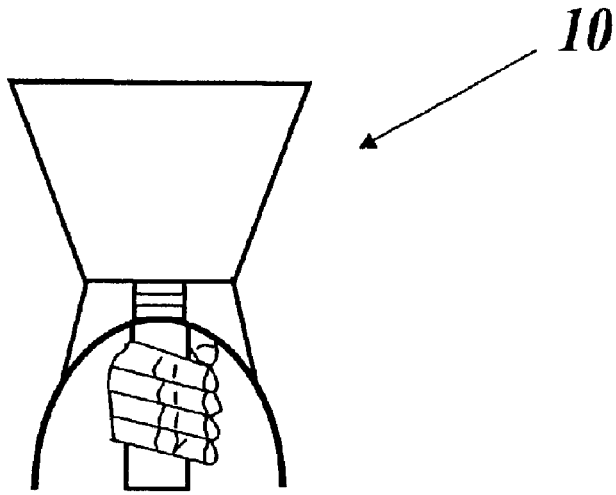
FIG. 5 is a front-view of a user holding the apparatus of FIG. 1.

The apparatus 10 ergonomically orients and positions a user's hand, wrist, and arm in the natural and comfortable position as shown in FIGS. 4 and 5. When using the apparatus 10, the user's wrist is maintained in a substantially unsupinated position, relieving the stress and discomfort which can accrue while holding the wrist in a supinated position for extended periods of time. A spacer 42 can be manufactured separately and located between the container 16 and the support 28 or can be formed as one unit with the container 16 or the support 28, according to a desired implementation. The apparatus 10 can be sized and dimensioned to accommodate users having different physical sizes, as well as accommodating different materials and material holders.

The apparatus 10 can be made from different materials, such as metallic and nonmetallic materials, like plastic polystyrene or stainless-steel. The container and support can be one-piece molded or two piece joined with a type of adhesive. Also, the apparatus 10 can be made from a combination of both plastic and metallic components.

Figure 6:
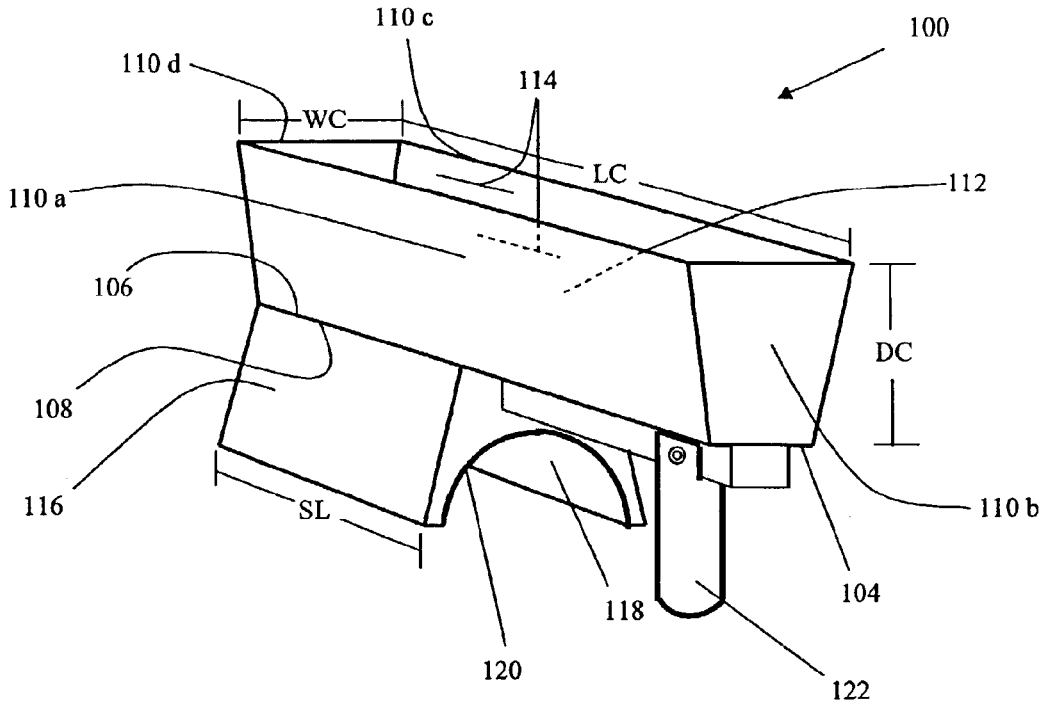
FIG. 6 is an isometric view of an ergonomic material holding apparatus according to another embodiment of the invention.

Referring now to FIGS. 6–10, a most preferred embodiment of an ergonomic material holding apparatus 100 is shown. FIG. 6 is an isometric view of a material holding apparatus 100, according to the most preferred embodiment A user 12 (FIG. 9) uses the material holder 100 to contain a material, such as concrete, drywall material, and other material types typically applied manually during building and other similar projects. The apparatus 100 is particularly useful to individuals who work in the building industry wherein various types of materials must be supported for prolonged time periods by a user 12. The apparatus 100 is particularly useful for material mixing applications.

Figure 14:
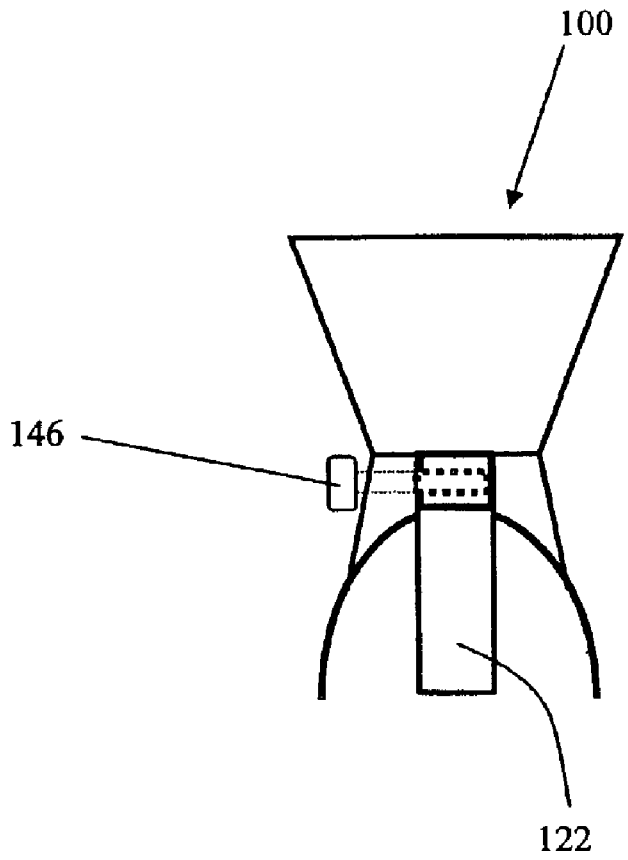
FIG. 14 is a front-end view the ergonomic container of FIG. 12.
Figure 17:
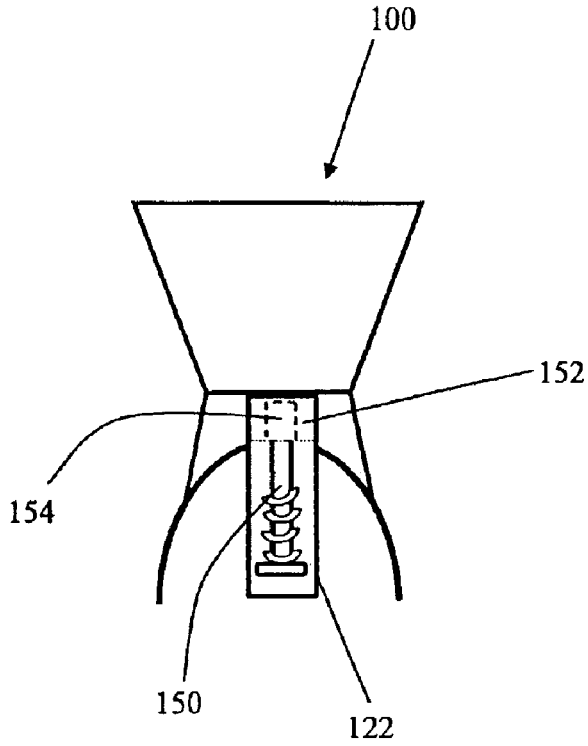
FIG. 17 is a front-end view the apparatus of FIG. 15.
Figure 18:
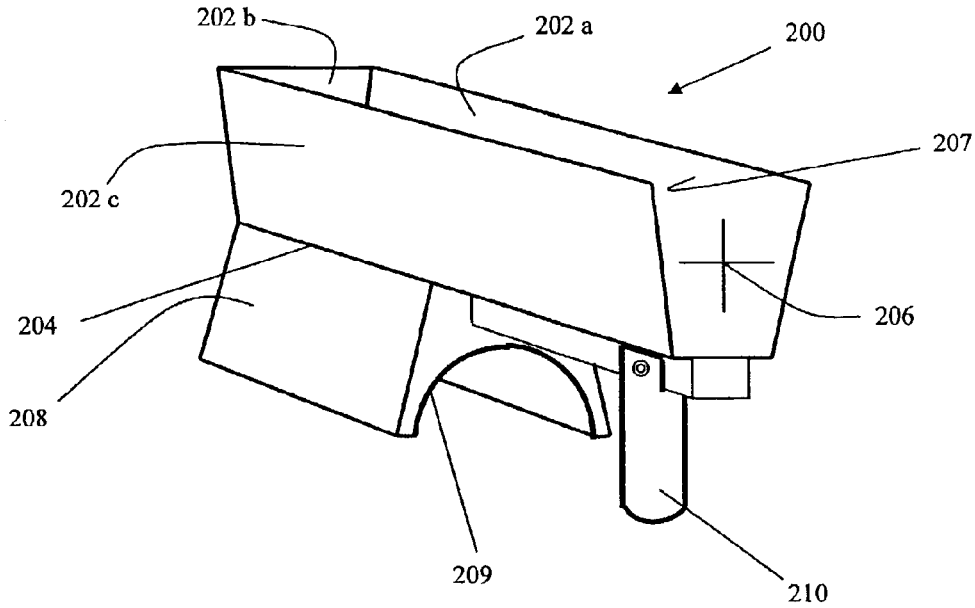
FIG. 18 is an isometric view of yet another embodiment of an ergonomic material holding apparatus.

As shown in FIGS. 6–10, the apparatus 100 includes a container 102 for containing a material or for supporting another container, such as a mixing pan, etc. which holds a material. The container 102 includes a base 104 having upper and lower surfaces 106 and 108, respectively. Four walls 110*a*–110*d* extend from the upper surface 106 of the base 104, defining a space 112 for receiving a material or another material pan which can hold a material. Preferably, the container 102 includes measurement levels or markings 114, as shown in FIGS. 11, 14, and 17.

Figure 8:
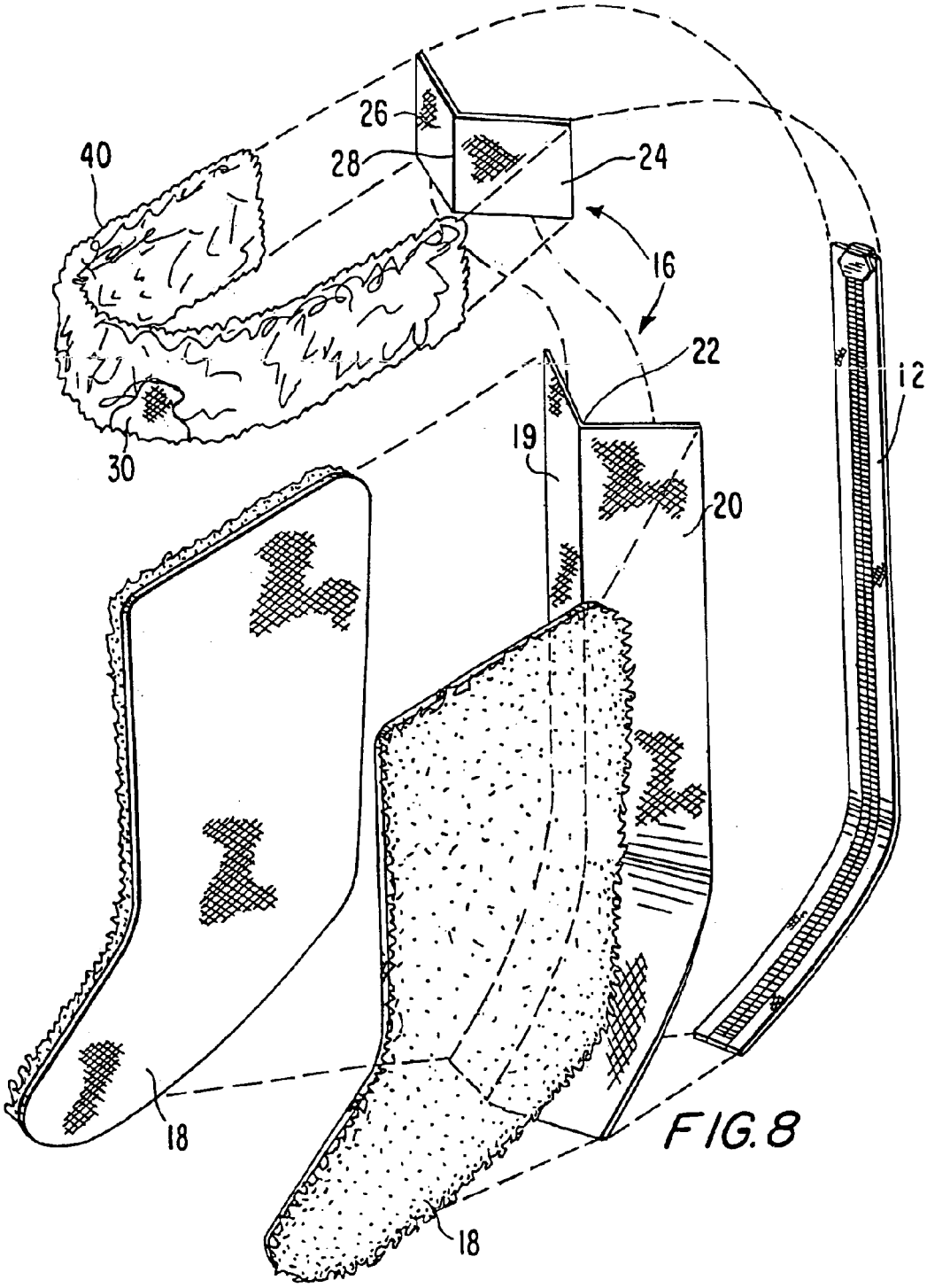
FIG. 8 is a front-end view of the apparatus of FIG. 6.

The apparatus 100 includes a support 116 attached to the lower surface 108 of the base 104. The support 116 has a shape which enables users having various arm sizes to use the apparatus 100. Preferably, the support has a length SL of between about five and about eight inches, and a radius RS of between about one and one-half (1½) to about three inches (FIG. 8).

A pad 118 is attached to the lower surface 120 of the support 116 and provides additional comforting and ergonomic properties to the apparatus 10. The pad 118 can be fabricated from any pliable material, such as foam, rubber, and the like. The pad 118 can be glued to or releasably affixed to the support 116, such as by tape, Velcro, and other adhesive means. When a user 12 uses the apparatus 100, the pad 118 provides a pliable support between the lower support surface 120 and the user's arm, providing additional ergonomic properties to the apparatus 100. The pad 118 prevents the lower support surface 120 from uncomfortably impinging upon or irritating the user's arm. Preferably, the pad 118 has a thickness of between about ⅛ inch and about ¾ inches. The pad 118 can cover the entire lower surface 120 of the support 116 or a portion thereof.

Figure 7:
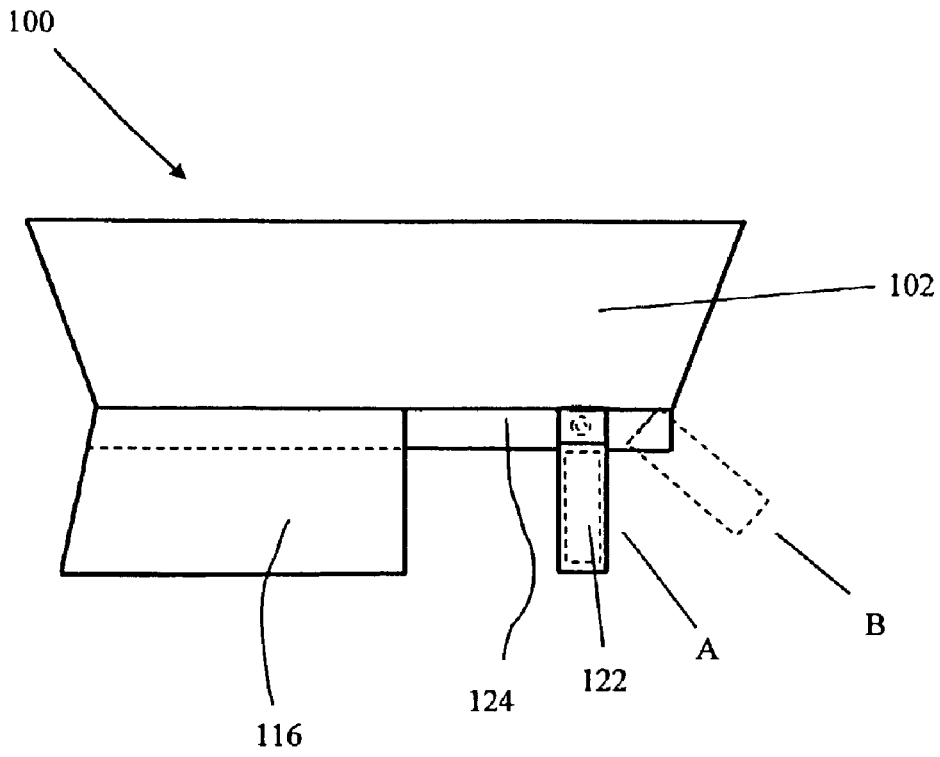
FIG. 7 is a side-view of the apparatus of FIG. 6.

According to this embodiment, the apparatus 100 further includes a handle 122. The handle 122 most preferably operates to adjust through a plurality of positions depending upon the user's size and particular application when using the apparatus 100. As described below, for this embodiment, the handle 122 can adjust both linearly and rotationally. As shown in FIG. 7, the handle 122 is shown in a first handle position A and a second handle position B. The handle 122 rotates through a plurality of angular positions including positions A and B.

Figure 9:
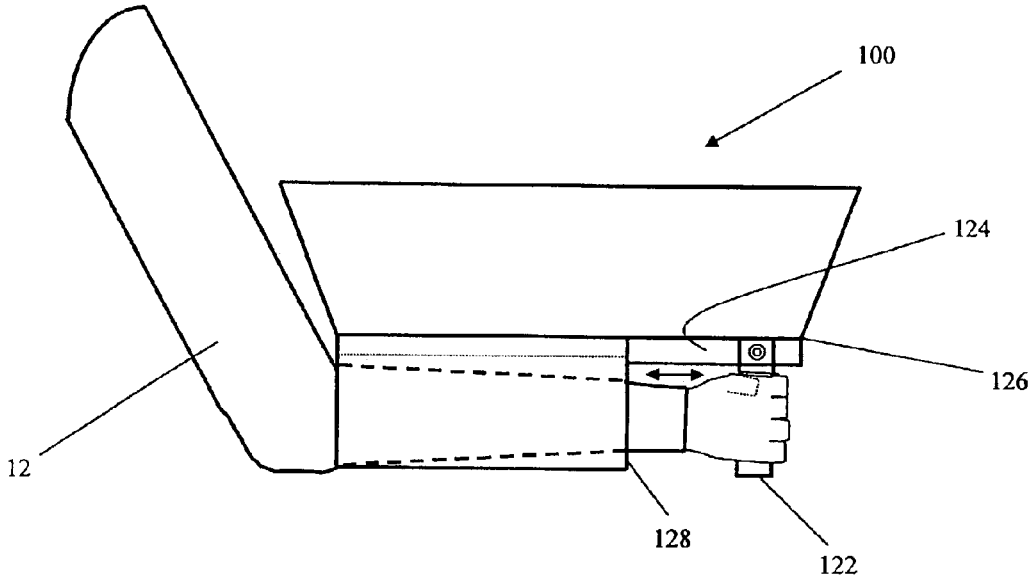
FIG. 9 is a side-view depicting a user holding the apparatus of FIG. 6.

For this embodiment, the handle 122 is attached to a track 124 and adjusts along its length (FIGS. 7 and 9). The track 124 is preferably located proximate the lower surface 108 of the base 104. Most preferably, the track 124 is centered upon the lower surface 108 of the base 104, between the front edge 126 of the container 102 and the front edge 128 of the support 116. The track 124 allows the handle 122 to be adjusted and locked into place between the front edge 126 of the container 102 and the front edge 128 of the support 116. The precise construction of the track 124 and handle 122 can be accomplished in a variety of ways which will be apparent to those skilled in the art.

For example, as shown in FIG. 11, the handle 122 can be located in a track 130 having at least one groove 134. The handle 122 includes a positioning member 132, such as a pin or threaded bolt and the like. The handle 122 is coupled to the grooved track 130 via coupling member 136 which slides upon the grooved track and is locked into place using the positioning member 132, such as by twisting the handle 122 that presses the positioning member 132 against the track locking the handle in the adjusted position relative to the track 130.

Figure 12:
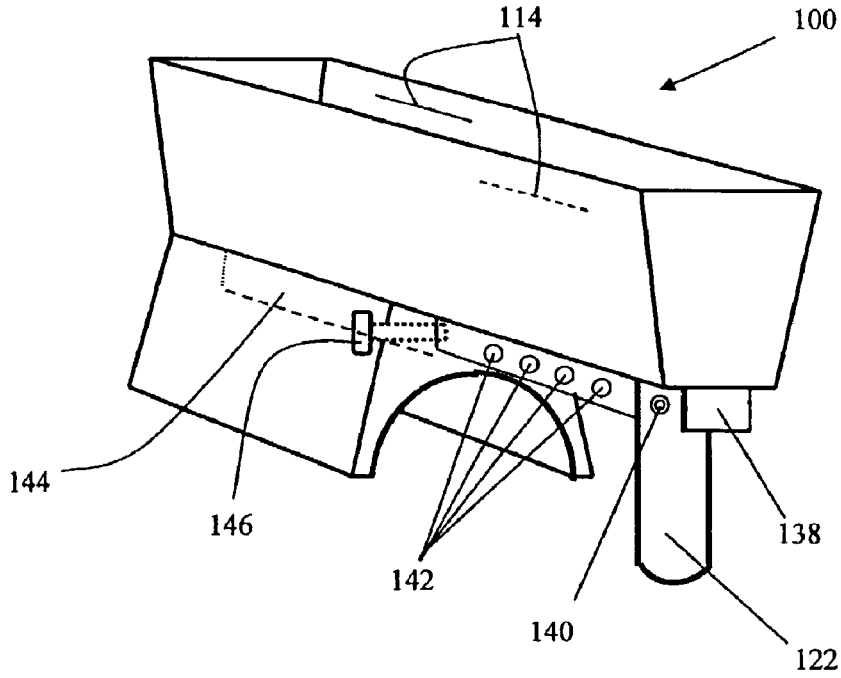
FIG. 12 is an isometric view of an ergonomic material holding apparatus having a handle adjustable along an orifice-laden track.
Figure 13:
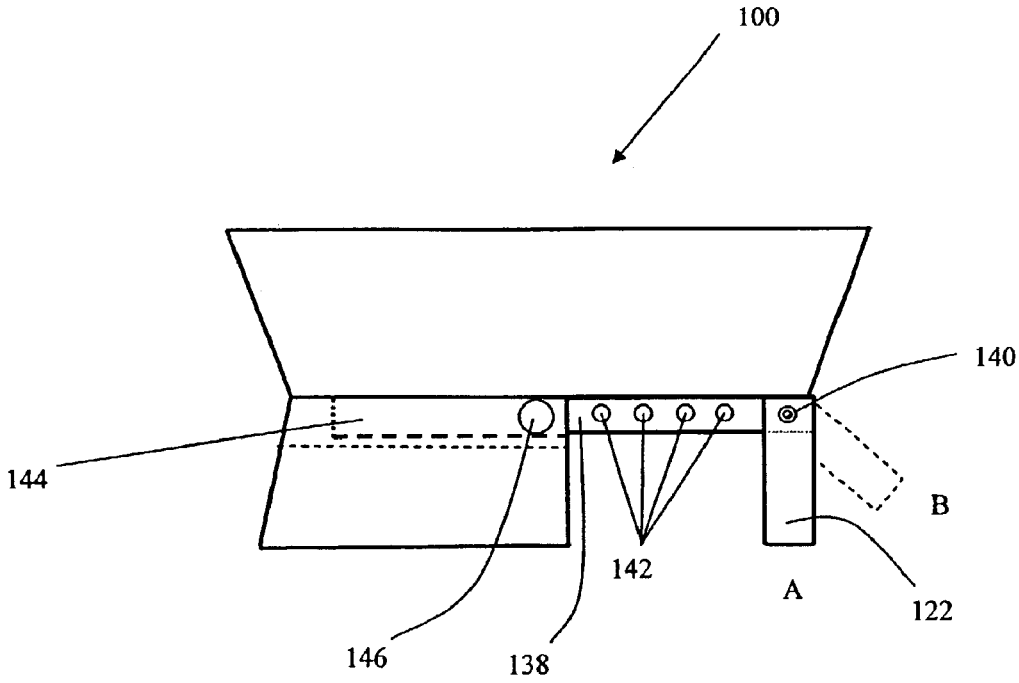
FIG. 13 is a side-view of the apparatus of FIG. 12.

As another example, as shown in FIGS. 12–14, the handle 122 is attached to a telescoping track 138 via a fastening member 140, such as a pin, rivet and the like. The telescoping track 138 includes a plurality of holes or indentations 142 along the outside edges or underside of the telescoping track 138 at set intervals. The telescoping track 138 slides into and out of a larger track 144. A spring-loaded pin 146 operates to lock the handle 122 in an adjusted location via the holes 142. Alternatively, the handle 122 can slide along a hole-laden track, wherein the handle 122 incorporates a spring-loaded pin 140 for locating the handle 122 along the track when the pin is inserted into a hole 142.

Figure 15:
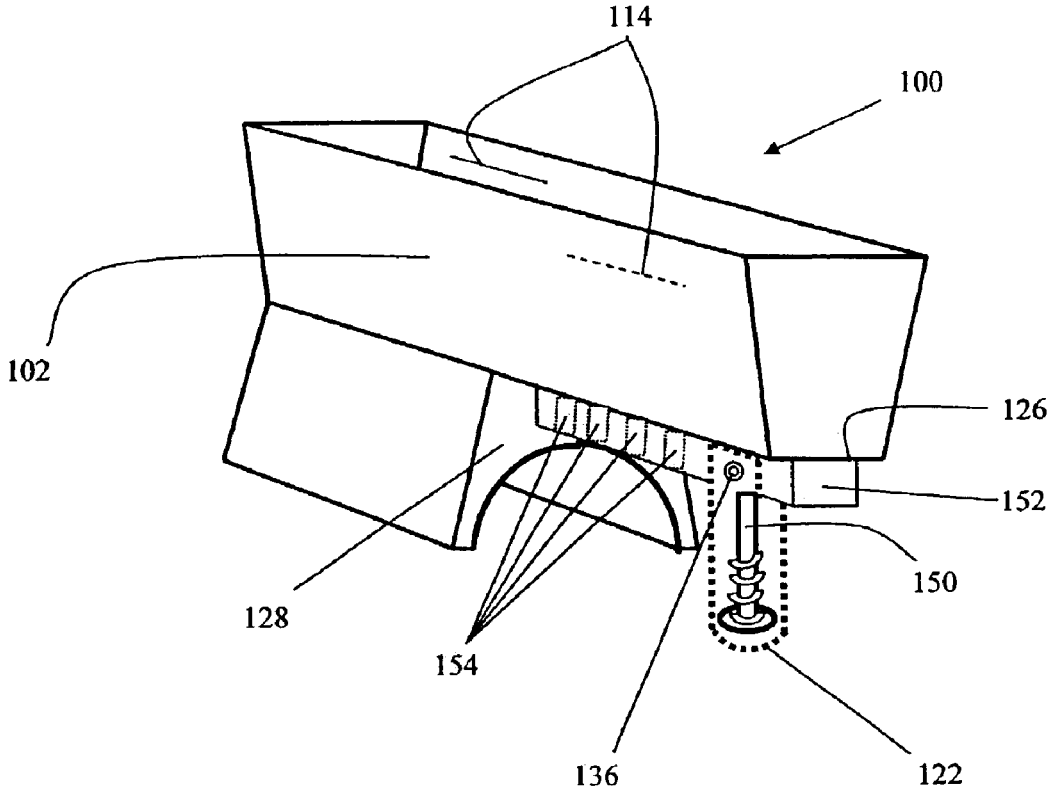
FIG. 15 is an isometric view of an ergonomic material holding apparatus having a handle adjustable along another embodiment of an orifice-laden track.
Figure 16:
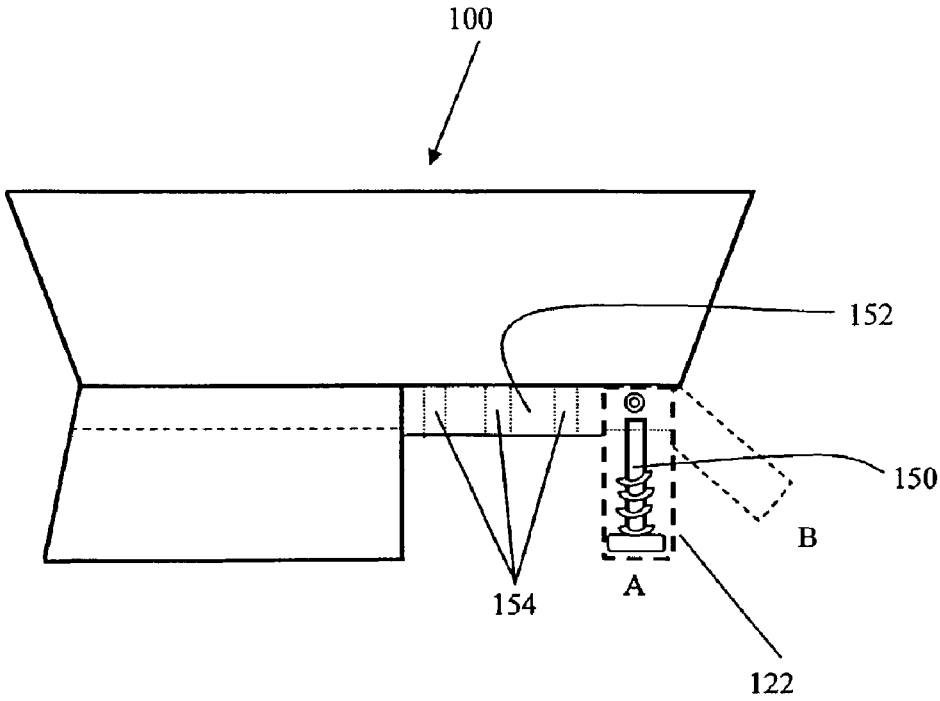
FIG. 16 is a side-view the apparatus of FIG. 15.

As yet another example, and referring now to FIGS. 15–17, the handle 122 contains a spring-loaded pin 150. The pin 150 can be locked into a track 152 having holes 154 or indentations along the underside of the track 152 at set intervals. In this way the track 152 remains stationary and the handle can move and be located along the track 152. As shown in these examples, the handle 122 can then be positioned at any point between the front edge 128 of the support 116 and the front edge 126 of the container 102.

The handle 122 allows for adjustments based on the length of the users arm as well as individual preferences based on their comfort, allowing the user 12 to keep his hand, wrist and arm in a more straight and natural position.

Figure 10:
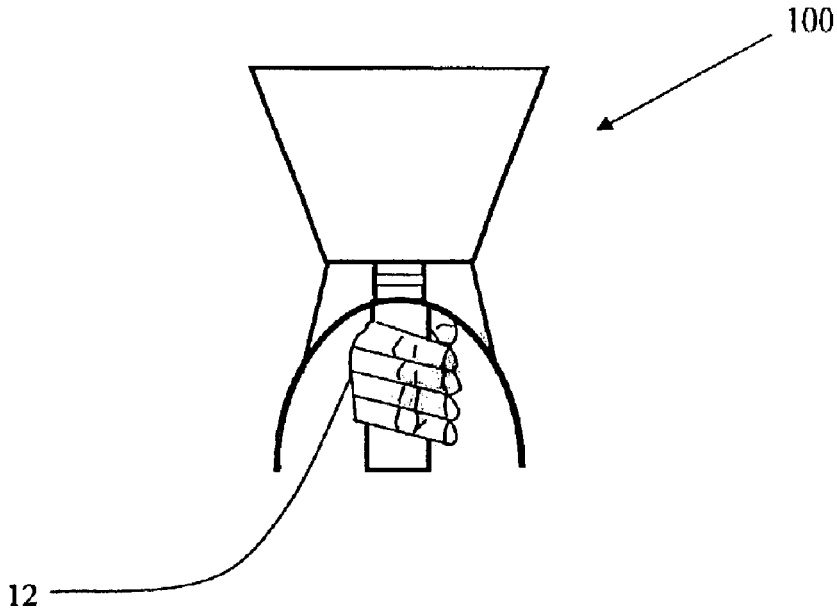
FIG. 10 is a front-view depicting a user holding the apparatus of FIG. 6.
Figure 11:
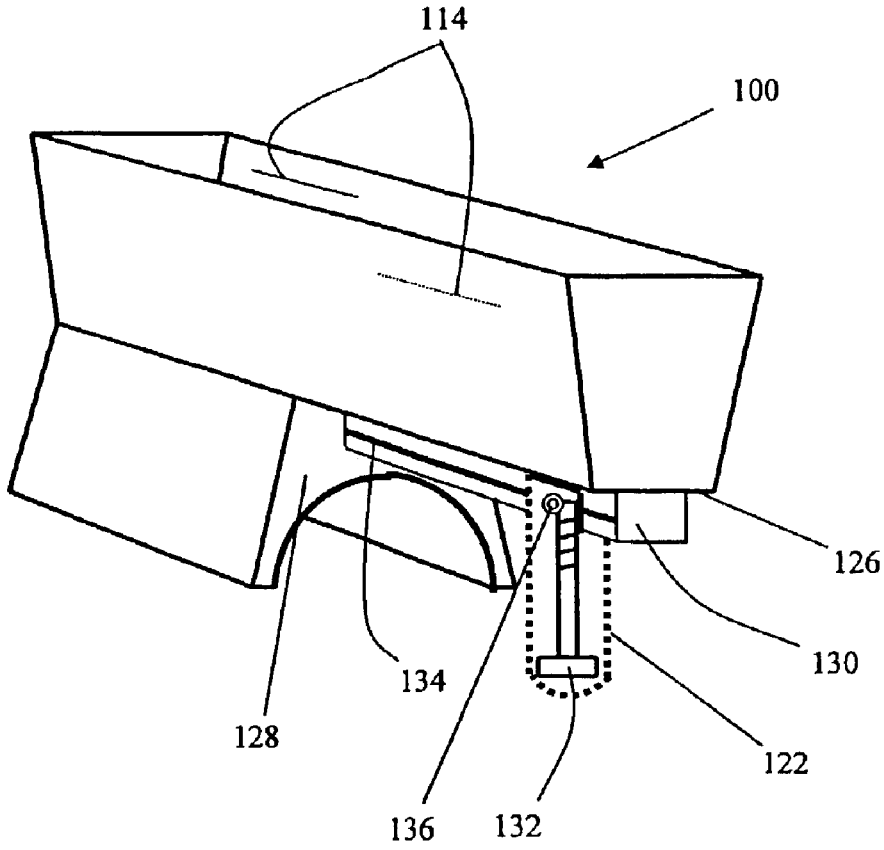
FIG. 11 is an isometric view of an ergonomic material holding apparatus having a handle adjustable along a grooved track.

The apparatus 100 ergonomically orients and positions a user's hand, wrist, and arm in the natural and comfortable position as shown in FIGS. 9 and 10. When using the apparatus 100, the user's wrist is maintained in a substantially unsupinated position, relieving the stress and discomfort which can accrue while holding the wrist in a supinated position for extended periods of time. The apparatus 10 can be sized and dimensioned to accommodate users having different physical sizes, as well as accommodating different materials and material holders.

Referring now to FIGS. 18–21, yet another embodiment of an ergonomic material holding apparatus 200 is shown. The apparatus 200 includes three walls 202*a*–202*c* and a base 204. The open-end 206 of the apparatus is for receiving standard mixing pans having standard dimensions, such as 10, 12 and 14 inch pans, and the like. The inner surfaces of the walls can be coated with a non-slip rubber or similar non-slip coating 207. The support 208, pad 209, and adjustable handle 210 are similar to the embodiments described above.

Figure 19:
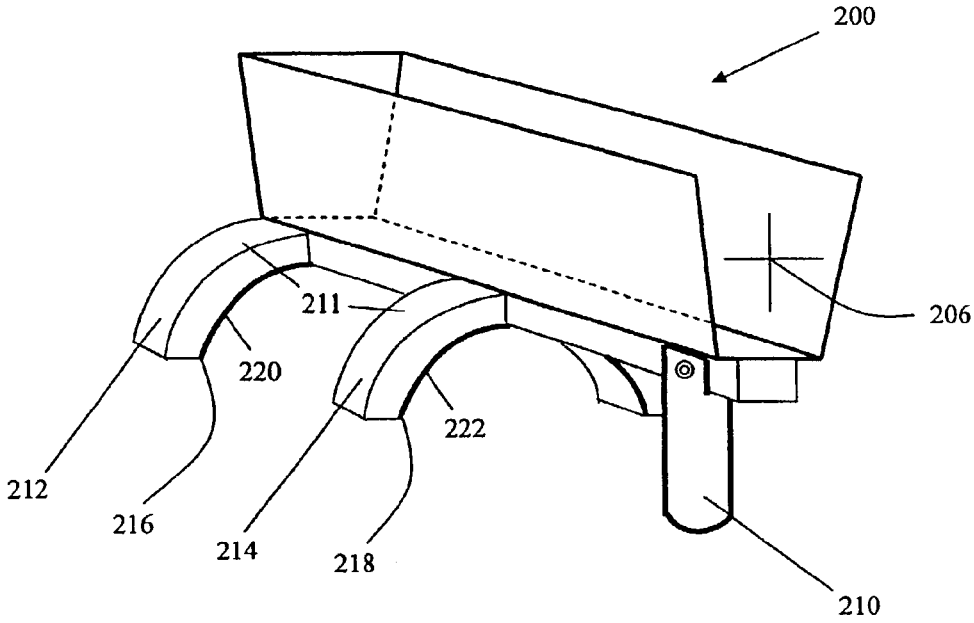
FIG. 19 is an isometric view of yet another embodiment of an ergonomic material holding apparatus.

According to an alternative embodiment, as shown in FIG. 19, the support 211 can be formed by one or more support members 212 and 214, strategically located along the base allowing air flow between the user's arm and the apparatus. This arrangement also allows a reduction in the material required to manufacture the apparatus 200. The lower surfaces 216 and 218 of the support members 212 and 214, preferably include pad members 220 and 222. The multi-member support can be utilized in the four-wall material holding apparatus as well.

Figure 20:
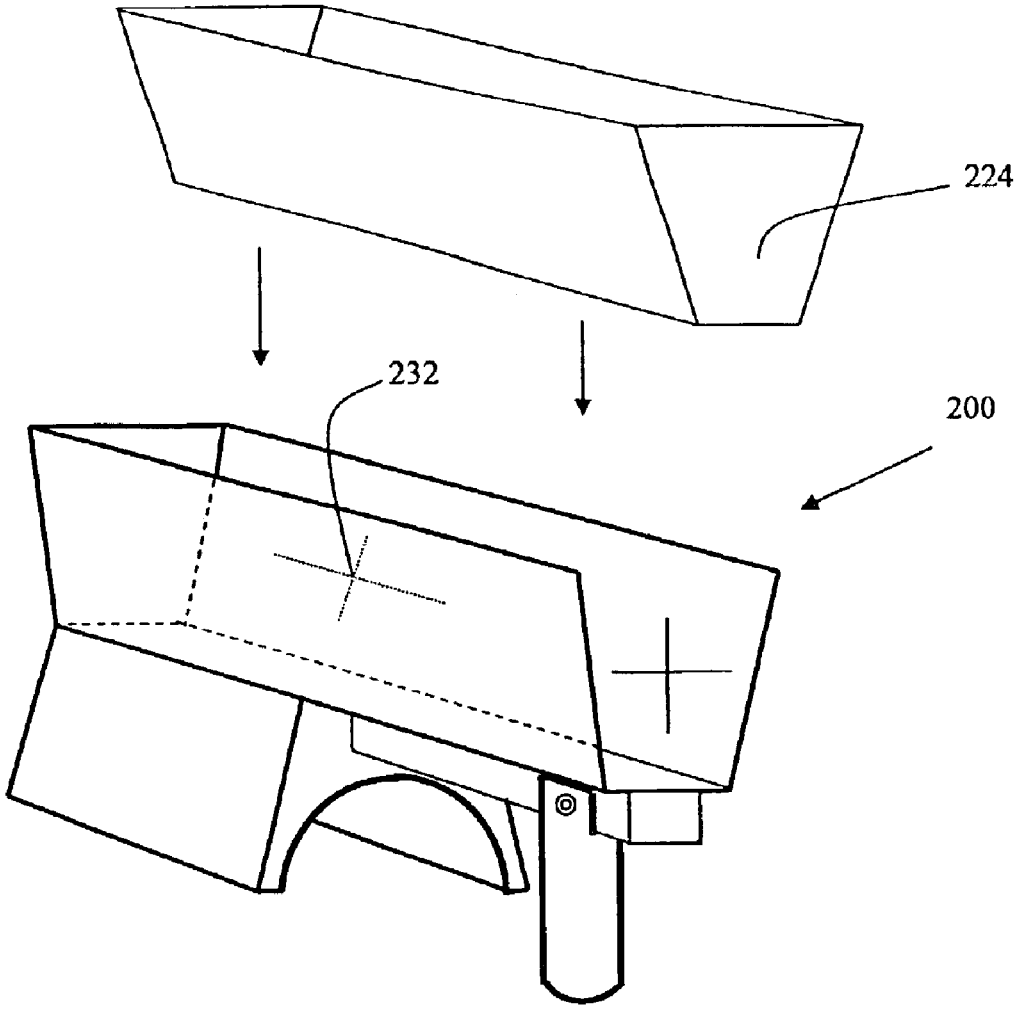
FIG. 20 is an isometric view depicting the insertion of a mud pan into the apparatus of FIG. 18.
Figure 21:
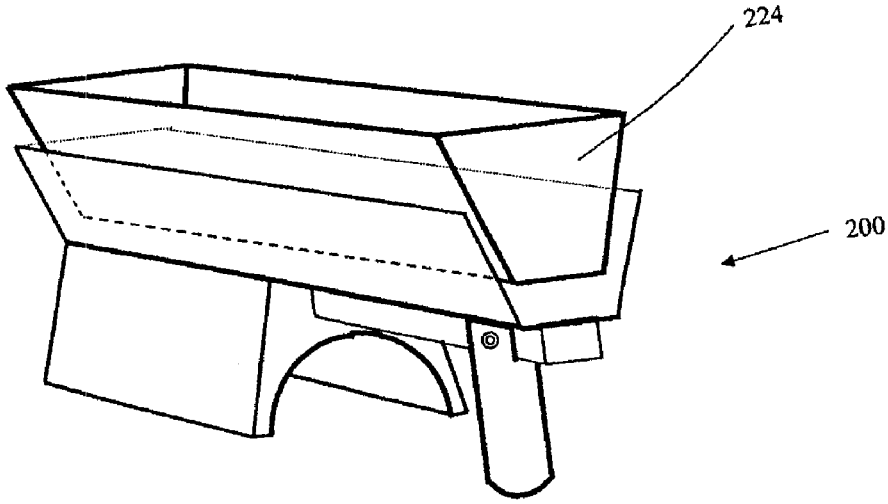
FIG. 21 is an isometric view depicting a mud pan seated in the apparatus of FIG. 18.

FIGS. 20 and 21 depict the insertion and holding of a material pan 224 by the apparatus 200.

Figure 22:
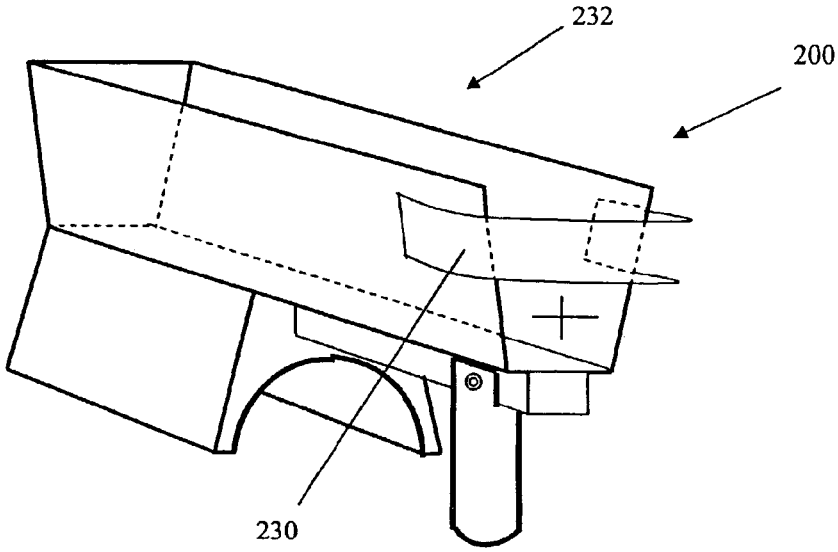
FIG. 22 is an isometric view of another embodiment of an ergonomic material holding apparatus.

Another embodiment of the open-ended material holding apparatus 200 is shown in FIG. 22. For this embodiment, the apparatus 200 includes a strap 230 which is operable to secure a pan in the receiving space 232 of the apparatus 200. The strap 230 can be made of any elastic or non-elastic material, such as rubber or nylon and can include various mechanisms to secure the strap to the apparatus 200, securely holding the separate pan and material contained therein in the receiving space 232.

It is contemplated, and will be apparent to those skilled in the art from the preceding description and the accompanying drawings that modifications and/or changes may be made in the embodiments of the invention. For example, the handle 34, 122 can be implemented as a strap or other non-rigid structure, cooperating with the support 28, 116 enabling the user to control the orientation of the apparatus 10, 100. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A portable, ergonomically designed apparatus for containing a building material comprising:

a container including:

a base having a length and a width, the base having upper and lower surfaces, and walls attached to the upper base surface, each wall having a length and width, wherein the walls and base define a receiving space, a substantially concave support having upper and lower surfaces, wherein a portion of the support's upper surface is attached to the lower base surface, the support being sized and dimensioned to rest upon a user's arm maintaining an ergonomic orientation of the user's arm in relation to the container, the handle and support enabling a user to orient the apparatus while carrying the building material and, a handle attached to the lower base surface, the handle providing a support for a user's hand, wherein the handle is operable to adjust linearly towards and away from said substantially concave support.

2. The apparatus of claim 1, wherein the handle is operable to adjust rotationally about a mount.

3. The apparatus of claim 1 wherein the receiving space has a size and a dimension for containing an amount of material.

4. The apparatus of claim 1 wherein the receiving space is sized and dimensioned to contain a pan having a predetermined size.

5. The apparatus of claim 1 further comprising a receiving member and a pin for removably securing the handle to the apparatus, wherein the handle is operable to rotate about the pin from a first position to a second position.

6. The apparatus of claim 1 further comprising a track located on the lower base surface, the track being sized and dimensioned to receive the handle, wherein a user can grasp and adjust the handle along the track from a first position to a second position.

7. The apparatus of claim 6, wherein the track has a length of between about three inches and about five inches.

8. The apparatus of claim 1 wherein the walls include a front wall, rear wall and two sidewalls defining said receiving space for receiving a material or a separate container.

9. The apparatus of claim 1 wherein the walls include two sidewalls and at least one wall positioned between the two sidewalls, the at least one wall and two sidewalls defining said receiving space for receiving a pan having predetermined dimensions.

10. The apparatus of claim 1, wherein the support has a length of between about five inches and about 14 inches.

11. The apparatus of claim 1, wherein the support has a shape which facilitates receiving a portion of a user's arm.

12. The apparatus of claim 1, wherein the support comprises one or more support members sized and dimensioned to receive a portion of a user's arm.

13. The apparatus of claim 1 further comprising a pad having a thickness, the pad being sized and dimensioned to attach to the support's lower surface for providing additional comforting features and ergonomic characteristics to the apparatus.

14. The apparatus of claim 1, wherein the container has a length of between about ten inches and about fourteen inches.

15. The apparatus of claim 1, further comprising a removable pan configured to place within the receiving space.

* * * * *

UNITED STATES PATENT AND TRADEMARK OFFICE

CERTIFICATE OF CORRECTION

PATENT NO. : 6,923,485 B1
DATED : August 2, 2005
INVENTOR(S) : Todd Bauswell

It is certified that error appears in the above-identified patent and that said Letters Patent is hereby corrected as shown below:

Drawings,
Delete the erroneous drawing Figure 8, and insert therefor the correct drawing Figure 8, as shown below:

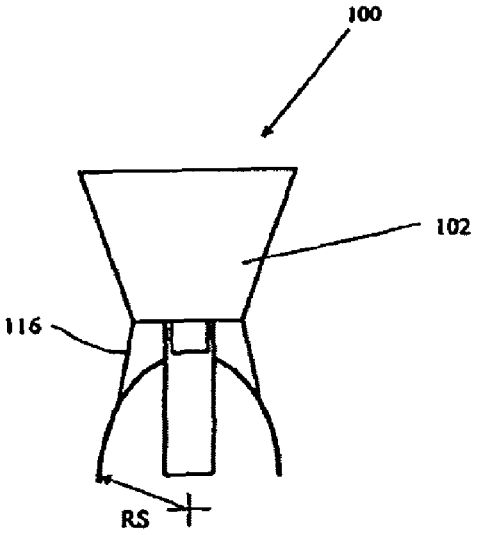

*Fig. 8*

Signed and Sealed this

First Day of November, 2005

JON W. DUDAS
*Director of the United States Patent and Trademark Office*